US006672669B2

(12) United States Patent
Chu et al.

(10) Patent No.: US 6,672,669 B2
(45) Date of Patent: Jan. 6, 2004

(54) SWINGABLE CHAIR BACK WITH TOP PIVOT

(75) Inventors: Zooey C. Chu, Grand Rapids, MI (US); David J. Lambert, Madison, MS (US)

(73) Assignee: First Source Furniture Group LLC, Nashville, TN (US)

( * ) Notice: Subject to any disclaimer, the term of this patent is extended or adjusted under 35 U.S.C. 154(b) by 0 days.

(21) Appl. No.: 09/999,216

(22) Filed: Nov. 30, 2001

(65) Prior Publication Data

US 2002/0158496 A1 Oct. 31, 2002

Related U.S. Application Data

(60) Provisional application No. 60/287,320, filed on Apr. 30, 2001.

(51) Int. Cl.[7] ..... A47C 1/024; A47C 3/026; A47C 7/54

(52) U.S. Cl. ..... 297/354.12; 297/354.11; 297/301.1; 297/301.3; 297/411.36

(58) Field of Search ..... 297/354.12, 354.11, 297/289, 301.1, 301.3, 301.4

(56) References Cited

U.S. PATENT DOCUMENTS

| | | | | |
|---|---|---|---|---|
| 135,465 A | | 2/1873 | Chichester | |
| 570,208 A | | 10/1896 | Harry | |
| 2,366,730 A | | 1/1945 | Hickman | |
| 3,215,468 A | * | 11/1965 | Swenson et al. | 297/354.11 |
| 3,259,435 A | | 7/1966 | Jordan, Jr. | |
| 4,157,203 A | * | 6/1979 | Ambasz | 297/354.11 |
| 4,333,683 A | * | 6/1982 | Ambasz | 297/301.1 |
| 4,408,800 A | | 10/1983 | Knapp | |
| 4,633,546 A | | 1/1987 | Bergs | |
| 5,112,108 A | | 5/1992 | Zapf | |
| 5,249,839 A | | 10/1993 | Faiks et al. | |
| 5,383,712 A | | 1/1995 | Perry | 297/354.11 X |
| 5,385,388 A | | 1/1995 | Faiks et al. | 297/301.3 |
| 5,601,335 A | | 2/1997 | Woods et al. | 297/301.3 |
| 5,697,673 A | * | 12/1997 | Favaretto | 297/301.1 |
| 5,806,931 A | | 9/1998 | Kogai | 297/301.3 |
| RE36,335 E | | 10/1999 | Perry | 297/354.11 X |
| 6,488,335 B1 | * | 12/2002 | Cioncada | 297/354.11 |
| 2002/0158496 A1 | * | 10/2002 | Chu et al. | 297/301.3 |
| 2002/0158500 A1 | * | 10/2002 | Chu et al. | 297/411.36 |

* cited by examiner

*Primary Examiner*—Rodney B. White
(74) *Attorney, Agent, or Firm*—Flynn, Thiel, Boutell & Tanis, P.C.

(57) ABSTRACT

A chair having a swingable chair back with a top pivot includes a frame having laterally spaced first and second uprights. A back having upper and lower ends is attached to the frame. Also attached to the frame adjacent the lower end of the back is a seat. A pivot assembly couples the first and second uprights to the back and permits pivoting of the back about a substantially horizontal pivot axis. The pivot axis projects laterally of the back and is positioned in the vicinity of the upper end of the back. A biasing device cooperates with the back and normally urges the lower portion of the back forwardly away from a rearward position.

16 Claims, 8 Drawing Sheets

SWINGABLE CHAIR BACK WITH TOP PIVOT

RELATIONSHIP TO OTHER APPLICATION

This application claims priority from provisional Application Ser. No. 60/287,320, filed Apr. 30, 2001 and entitled CHAIR.

FIELD OF THE INVENTION

This invention relates to a chair of the type used in offices and the like, and in particular to an improved chair back having limited vertical swinging movement about an axis disposed adjacent the upper edge of the back.

BACKGROUND OF THE INVENTION

Chairs of the type used in offices and the like are often utilized for permitting a seated occupant to carry out work-intensive tasks adjacent a desk or worksurface, including keyboarding and other tasks which require the person to sit generally upright or even lean forwardly so as to partially overlie a worksurface. When used in this manner, the back of the chair generally loses contact with the occupant's back, and thus provides no supportive engagement therewith.

It is an object of this invention to provide an improved office-type chair wherein the back of the chair has limited vertical swinging movement generally about the upper portion thereof so that when a person using the chair leans forwardly, the back of the chair will be urged forwardly, as by a spring, through at least a limited extent and hence the lower portion of the chair back, such as in the lumbar region, will continue to maintain supportive engagement with at least the lower back of the chair occupant.

SUMMARY OF THE INVENTION

This invention is directed to a new and useful chair including a frame having laterally spaced first and second rigid uprights. A back is attached to the frame and includes upper and lower ends. Also attached to the frame adjacent to the lower end of the back is a seat. A pivot assembly couples the first and second uprights to the back for permitting pivoting of the back about a substantially horizontal pivot axis that projects laterally of the back and is positioned in the vicinity of the upper end of the back. The pivot assembly includes a spring arrangement that exerts a force on the back a substantial distance below the pivot axis for biasing the back toward a forward position.

Other objects and purposes of the invention will be apparent to persons familiar with constructions of this type upon reading the following specification and inspecting the accompanying drawings.

DETAILED DESCRIPTION

Figure 1:
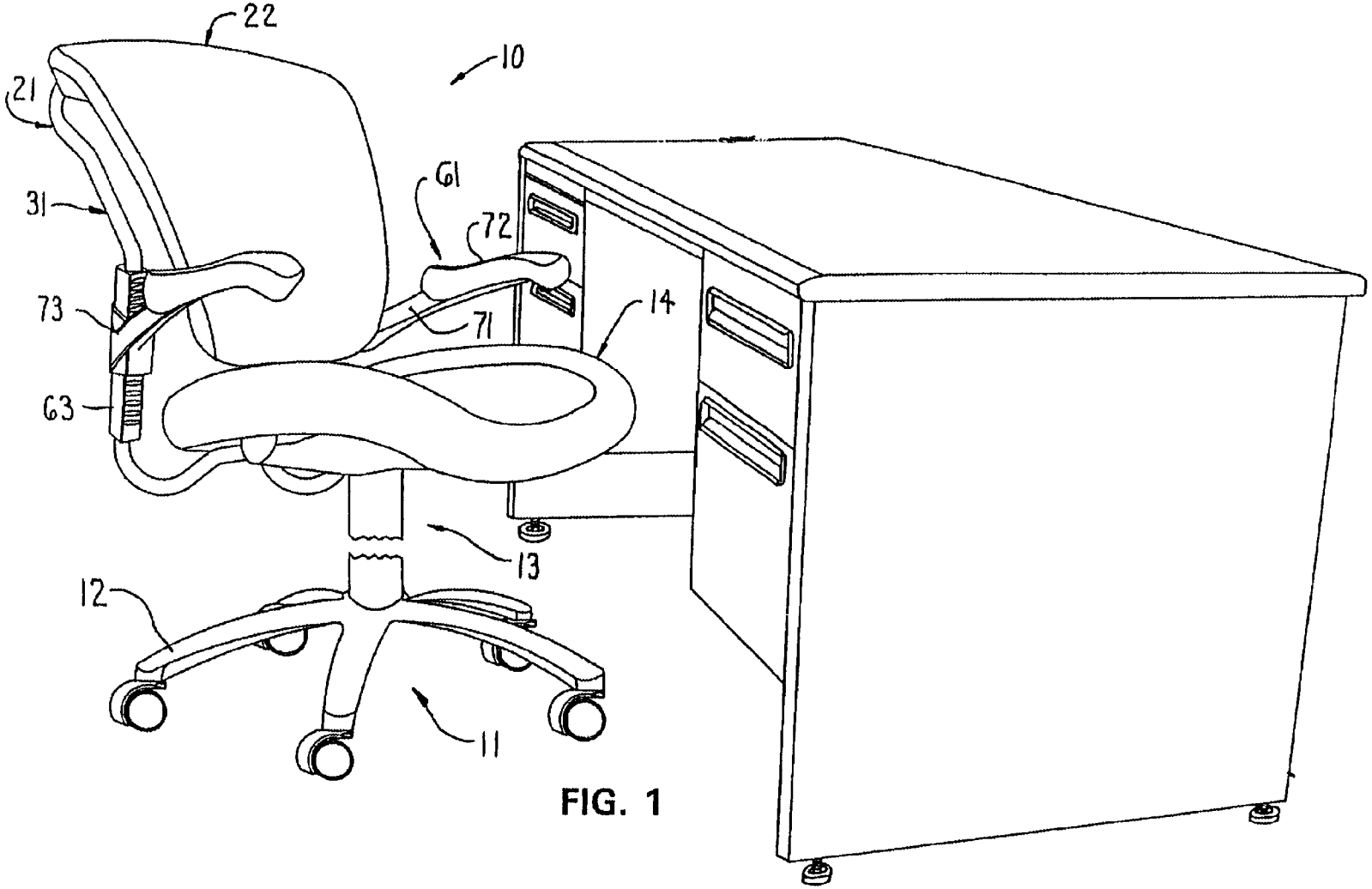
FIG. 1 is a perspective view of a chair according to the present invention shown positioned adjacent a conventional desk.
Figure 2:
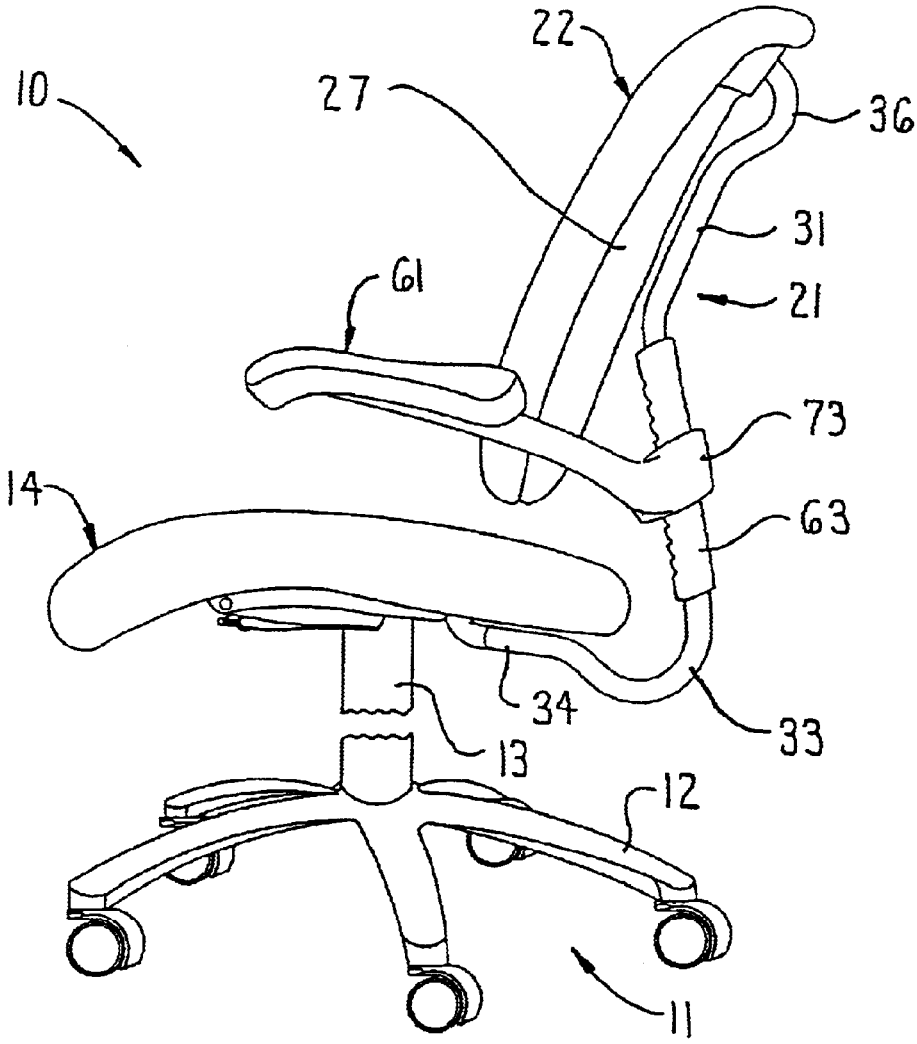
FIG. 2 is a side view of the chair shown in FIG. 1.
Figure 3:
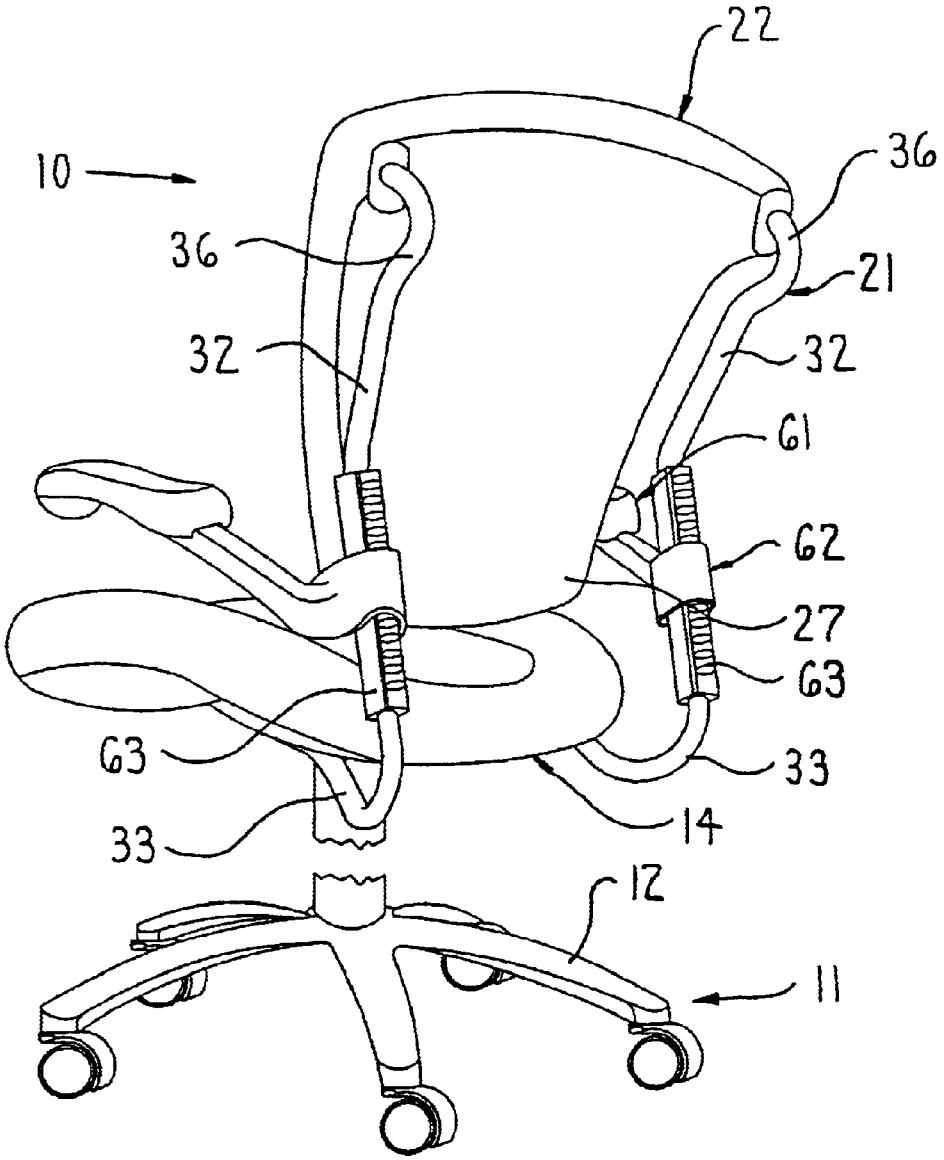
FIG. 3 is a further perspective view taken generally from the rear of the chair shown in FIG. 1.

Referring to FIGS. 1–3, there is illustrated a chair 10 according to the present invention. This chair includes a conventional base 11 having legs 12 and a central height-adjustable pedestal 13 projecting upwardly therefrom. The pedestal at its upper end connects to the underside of a generally horizontally enlarged seat arrangement 14. The seat arrangement 14, as is generally conventional, includes a generally rigid structural inner shell 15 having a cushion thereover 16, with the cushion and shell being generally enclosed by a surrounding covering such as a fabric or vinyl covering.

A back frame structure 21 joins to the underside of the seat structure 14 and projects upwardly for supportive engagement with a back arrangement 22 which projects upwardly from the seat arrangement 14 in the vicinity of the rear edge thereof. This back arrangement 22, in the illustrated embodiment of the invention, has chair arms 61 associated therewith, which chair arms are cantilevered forwardly from the back frame arrangement 21 and are mounted for height adjustment with respect thereto.

The back arrangement 22 includes an inner structural back member or shell 23 typically constructed of wood or rigid plastic, and this inner shell is appropriately covered on a front side thereof with a cushion 24 such as of plastic foam, and the inner shell and foam cushion are appropriately enclosed within an outer covering of fabric, vinyl or the like. The rear of the back arrangement is typically closed by a rear cover or shell 27 which overlies the inner structural shell and is secured thereto. The general construction of the back arrangement 22, like the seat arrangement, is conventional.

Figure 4:
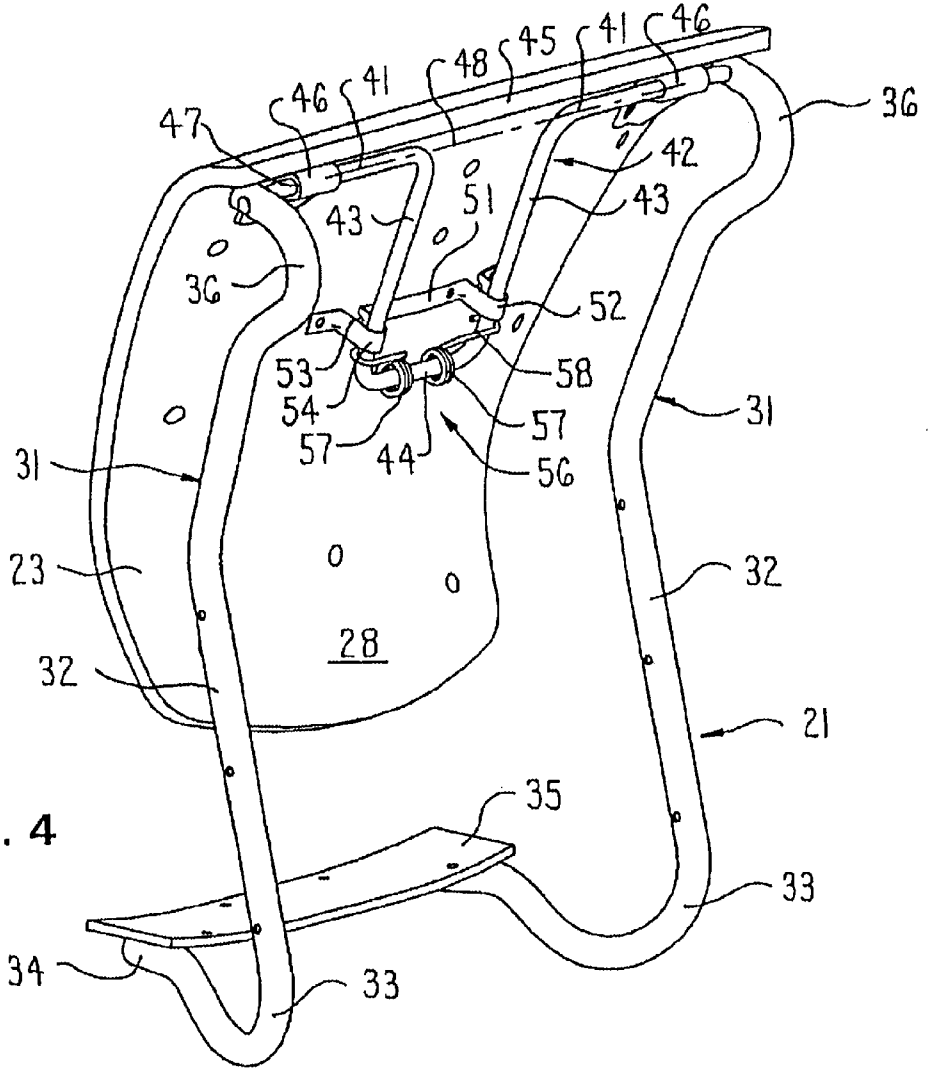
FIG. 4 is a perspective view which illustrates solely the back frame for the chair back of this invention and its connection to the rear inner shell of the chair back.
Figure 6:
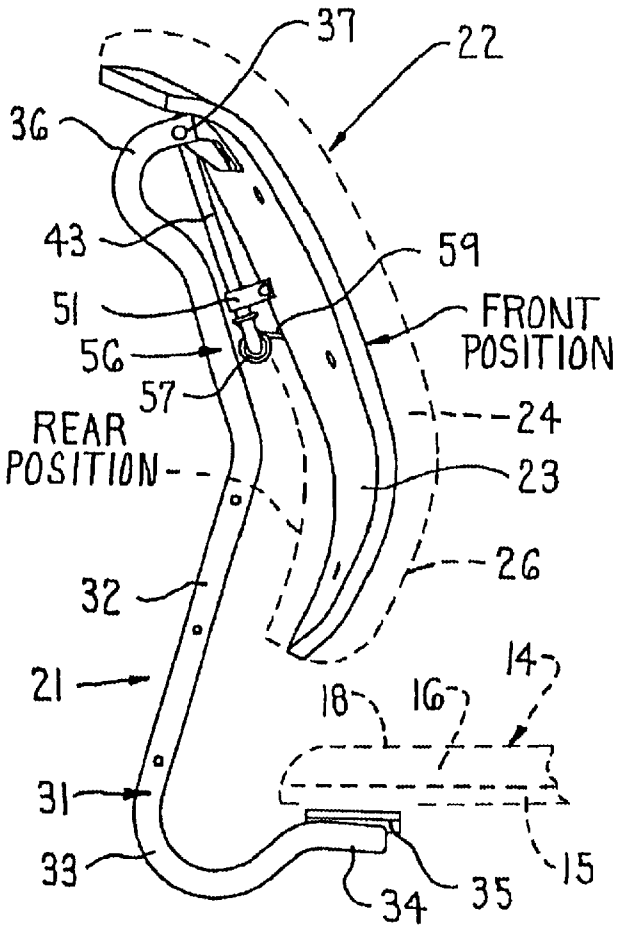
FIG. 6 is a side elevational view of the arrangement shown in FIGS. 4 and 5.
Figure 5:
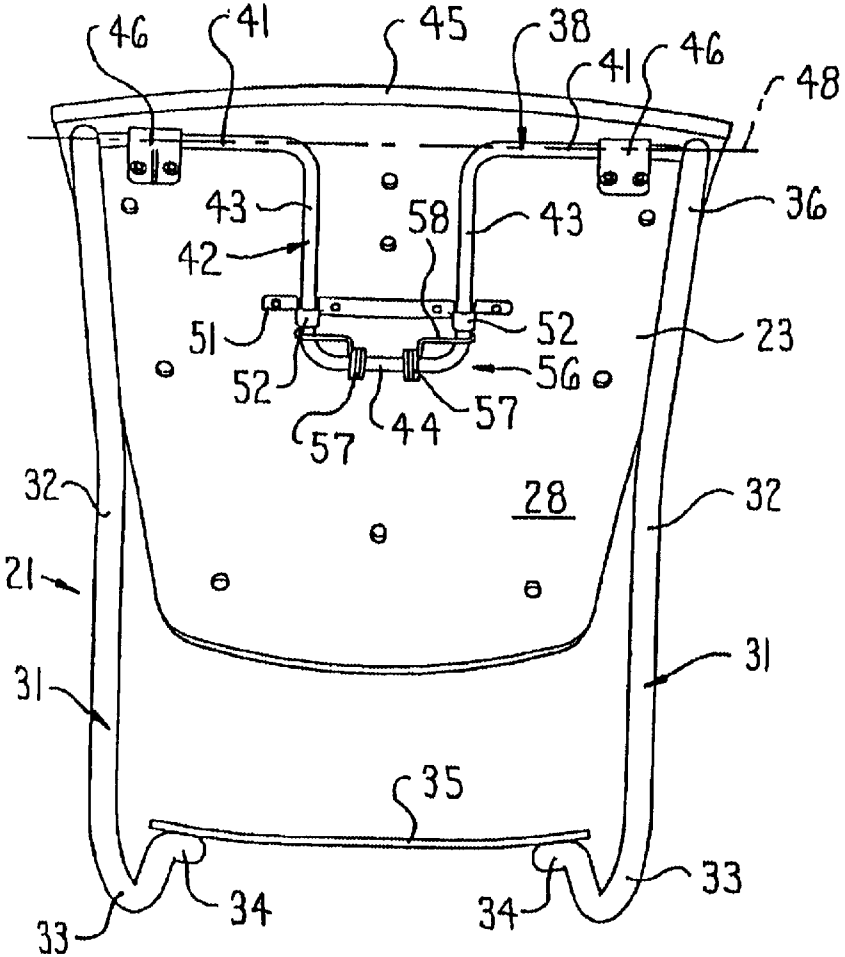
FIG. 5 is a back elevational view of the construction illustrated in FIG. 4.

The back frame arrangement 21 as illustrated in FIGS. 4–6 includes a pair of generally upright frame members 31 which are substantially identical except for being mirror images of one another so as to be disposed adjacent the right and left sides of the chair back. Each upright frame member 31 includes a main elongate center part 32 which extends generally vertical and which at a lower end joins to a curved portion 33 which projects forwardly so as to terminate at a lower free end part 34. The lower free end parts 34 of the upright frame members 31 are rigidly joined by a cross strap or plate 35, the latter in turn being fixedly secured to the underside of the structural shell 15 associated with the seat arrangement 14. The upright frame members 31, at the upper ends thereof, are also provided with curved portions 36 which form an upper leg which projects toward and terminates in a free end 37 disposed adjacent the rear surface 28 of the inner back shell 23 in the vicinity of the upper edge 45 thereof.

The pair of sidewardly-spaced upright frame members 31, at their upper ends, are rigidly joined by a top cross rod or bar 38 which has the free ends thereof non-rotatably and fixedly joined to the upper free end parts 37 of the side frame members 31. This cross bar 38, extending inwardly from the free ends thereof, has generally aligned and substantially horizontally extending rod portions 41 which project inwardly from the side frame members toward the center of the back shell. These horizontal rod members 41 are bent through about 90° angles and joined to a generally U-shaped center rod portion 42. This center rod portion 42 includes side legs 43 which project generally vertically downwardly adjacent the rear surface of the back shell 23, and these side legs 43 join through generally right angle bends to a bottom cross rod 44 which extends generally horizontally. The cross bar 38 and its rigid securement between the upper ends of the spaced side frame members 31, and the bottom strap 35 and its rigid securement between the lower ends of the side frame members 31, thus define a rigid frame assembly which is of a generally closed endless configuration, and provides a connection to support the back arrangement 22 from the seat arrangement 14 as described hereinafter.

To connect the back arrangement 15 to the frame arrangement, the back shell 23 fixedly mounts thereon, in the vicinity of the upper corners thereof, a pair of sidewardly spaced journals or bearings 46 which are fixed to and project outwardly from the rear surface 28 of the back shell 23. This pair of spaced journals 46 define aligned openings 47 therein in which are snugly but rotatably accommodated the horizontal rod parts 41 of the cross bar 38. This connection of the horizontal rod parts within the journals secured to the back shell thus couples the back shell 23, and hence the back arrangement 22, to the frame assembly 21 while permitting relative pivoting of the back arrangement 22 about the longitudinally extending horizontal axis 48 defined by the horizontal rod parts 44.

To control and limit the amount of pivoting movement of the back arrangement 22 relative to the back frame assembly 21 about the pivot axis, the back assembly 22 has a restraining member 51 fixedly secured to and projecting rearwardly from the rear surface of the back shell 23 at an elevation which is spaced downwardly a substantial distance below the horizontal pivot axis 48. This restraining member 51 in the illustrated arrangement is formed generally as a horizontally elongate strap which is fixedly secured to the back shell 23, and the strap has a pair of control parts 52 in sidewardly spaced relationship therealong. These control parts 52 are formed generally as U-shaped parts, or yokes, and effectively extend around and provide control over the vertical rod portions 43. More specifically, each of the control yokes 52 has generally parallel side legs 53 which are spaced apart so as to permit the side rods 43 to move lengthwise of the control yoke until restricted by the closed end 54 of the yoke which is spaced from the rear surface 28 of the seat shell 23 and functions as a stop. These control yokes 51 thus permit the back shell 23 to pivot about the horizontal pivot axis 48 through a limited extent as permitted by the vertical rods 43 abutting the ends of the yokes 52 as a forward limit position, and by the shell 23 swinging rearwardly into a rearwardmost position in which it effectively abuts the U-shaped center rod part 42. The forward and rearward positions are diagrammatically indicated in FIG. 6.

The back arrangement 22 is normally maintained in its forwardmost position by the urging of a spring arrangement 56 which, in the illustrated embodiment, comprises two coil-type torsion springs 57 which surround the horizontal center rod part 44 and have one leg 58 thereof anchored to the rod, with the other leg 59 of each torsion type coil spring being in abutting engagement with the rear surface of the back shell 23. The legs 59 of the torsion springs which project inwardly for contact with the back shell 23 are, in the preferred embodiment, joined together to define a generally U-shaped configuration which bears against the rear surface of the seat shell at a location disposed in the vicinity of the horizontal rod part 44 and hence vertically approximately at the middle of the back shell. The contact of the spring against the seat shell is thus spaced a substantial distance downwardly from the pivot axis 48 and hence, acting through the long lever arm defined between the pivot axis and the spring, urges the seat shell 23 forwardly into the forward position as limited by the vertical rods 43 contacting the stop parts 54 defined at the ends of the control yokes 52.

When the chair of this invention is not occupied, the spring 56 will normally urge the back arrangement 22 forwardly (counter-clockwise in FIG. 6) about axis 48 into the forwardmost position for the back. When the chair is occupied, however, and the occupant leans against the back in the normal manner, the force imposed on the back 22 by the occupant will overcome the spring force and the back will swing back (clockwise) into its rearwardmost position wherein the back shell 23 abuts the U-shaped rod part 42 and thus defines a generally solid or rigid back assembly.

However, if the occupant leans forwardly and relieves the force against the back 22, such as when carrying out an intensive task on a table, such as a keyboarding function, then the back of the occupant will partially move away from the back and relieve the load on the back. At the same time, however, the spring 56 acting against the back shell 23 causes the lower portion of the back 22 to pivot forwardly about the top hinge axis 48, and thus the lower portion of the back 22 will be disposed so as to continue to maintain supportive engagement with at least the lower portion of the occupant's back, particularly in the lumbar area.

Since the torsion springs 57 and their reaction against the rear surface of the back shell 23 occurs at a point which is spaced downwardly a substantial distance below the hinge axis 48, the springs 57 acting through the large lever arm created by this spacing thus results in creation of a significant mechanical advantage so that a rather significant moment can be applied to the back 22 about the pivot axis 48, even though the individual torsion springs themselves are small, and thus a significant force urging the lower portion of the back 22 forwardly can be achieved so as to continue to maintain partial supportive contact with the lower region of the occupant's back.

At the same time, however, the overall mechanism including the cross bar 38 as well as the restraining member 51 and springs 57 is small and compact, and can be easily enclosed in a small space defined between the inner structural back shell 23 and the outer rear cover 27. The uprights 31, however, and specifically the elongate upright parts 32 are positioned exteriorly of the back arrangement 22 and connect thereto only adjacent the upper corners thereof.

Considering now the construction and operation of the height-adjusting chair arms 61 as associated with the chair of this invention, each height-adjusting chair arm 61 includes an elongate support sleeve 63 which is fixed to and encircles the vertically extending portion 32 of the respective side frame member 31 over a significant extent of the length thereof. This tubular support member 63 has an opening therethrough for snugly receiving therein the elongate straight portion 32 of the side frame member 31, and the tubular support member 63 is formed in two halves which enable it to be snugly clamped around the side frame member and then secured thereto by screws or similar fasteners which extend through the two halves of the support member as well as the side frame member.

The tubular support member 63 has an exterior configuration which is preferably polygonal and is defined by a plurality of flat sides, which exterior polygonal configuration in the preferred embodiment is generally rectangular and more specifically square.

The exterior front side wall 64 of the support tube 63 has a toothed or racklike configuration formed thereon throughout the vertical extent thereof, whereby adjacent teeth 65 are vertically separated by a notch or recess 66 which extends transversely (i.e. generally horizontally) with the upper side of this notch merging smoothly into a ramplike surface which slopes outwardly and upwardly to define the tooth.

The opposite or rear flat wall 67 of the support tube 63 is generally flat but has a series of transversely (i.e. horizontally) extending notches or recesses 68 formed therein. The series of notches 68 are disposed in vertically spaced relationship along the support tube, with the vertical spacing between adjacent notches 68 generally corresponding to the vertical spacing between adjacent recesses 66 associated with the front wall of the support tube 63.

The upright back frame members 31 are disposed substantially totally exteriorly of the back arrangement 22, and the elongate vertical uprights 32 associated with the back frame members 31 are disposed so that they are positioned closely adjacent but spaced slightly rearwardly and slightly outwardly from opposite sides of the back arrangement 22. Each of the elongate vertical upright portions 32 of the back frame elements 31, specifically those portions having the support tubes 63 secured therearound, support thereon one of the cantilevered arm assemblies 61.

Each cantilevered arm assembly 61 includes a generally horizontally elongate arm member 71 which is mounted on and projects forwardly from the respective support tube 63, with this arm member in turn having a top cap member 72 fixedly mounted thereon, which top cap member typically incorporates some type of resilient cushioning material enclosed within an appropriate exterior cover, such as is conventional, so that further description thereof is believed unnecessary.

Figure 8:
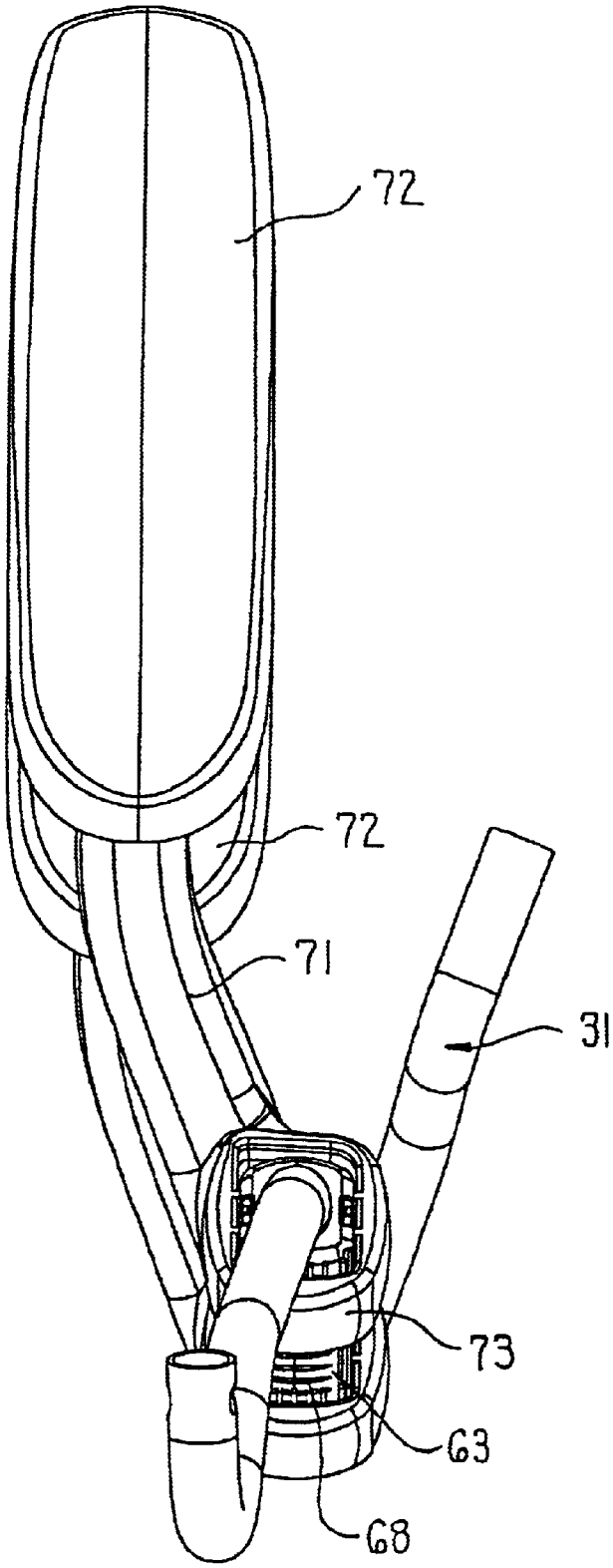
FIG. 8 is a top view of the arrangement shown in FIG. 7 and showing both positions of the chair arm in solid lines.

The arm member 71 at the rearward end thereof is provided with a sleeve part 73 which has an opening 74 extending vertically therethrough, the cross section of which is noncircular and is sized so as to nonrotatably but vertically axially accommodate therein the respective support tube 63, as illustrated in FIG. 8.

The sleeve part 73 defines thereon, on the front side of the interior opening 74 adjacent the lower end thereof, a transversely extending rib 75 which projects rearwardly into the interior of the sleeve part and is sized so as to engage a selective one of the recesses 66 defined between the teeth 65 on the front or rack-bearing side of the support tube 63.

The rear side of the opening 74, in the vicinity of the upper end thereof, has a further rib 76 which extends transversely and projects outwardly in a forward direction so as to terminate in a generally flat outer end. This latter projection 76 is adapted to bear against the rear surface 67 of the support tube 63 in the flat regions between the notches 68. This rear projection 76 is also disposed vertically upwardly a substantial distance above the front projection 75, as illustrated by FIG. 7.

The support hub 73 on the arm member 71 also has a small platelike spring 77 which is mounted interiorly thereof and has a cantilevered portion which terminates in a free end part 78 adapted to resiliently engage one of the latching notches 68 formed on the rear wall of the support tube 63. This spring 77 has the upper end thereof secured over the rear support rib 76 associated with the support hub so that the spring is fixed to and hence carried with the support hub 73. The spring 77 as it projects downwardly is cantilevered so as to be resiliently urged forwardly for engagement with the rear wall 67 of the support tube 63.

Figure 7:
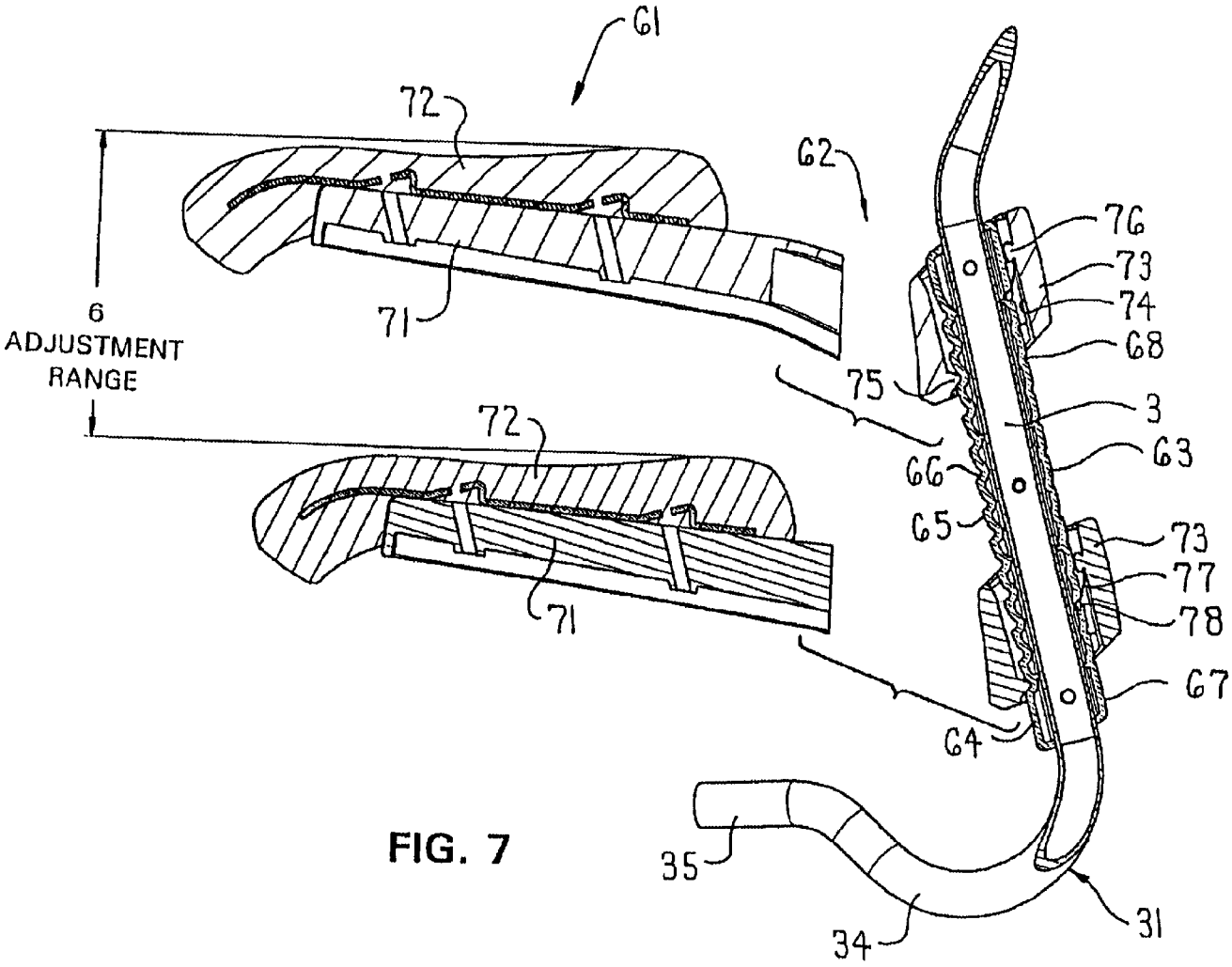
FIG. 7 is a side elevational view showing in cross sectional view the chair arm and its connection to the upright associated with the back frame, and specifically showing in solid lines the chair arm in both its uppermost and lowermost height adjusted positions.
Figure 9:
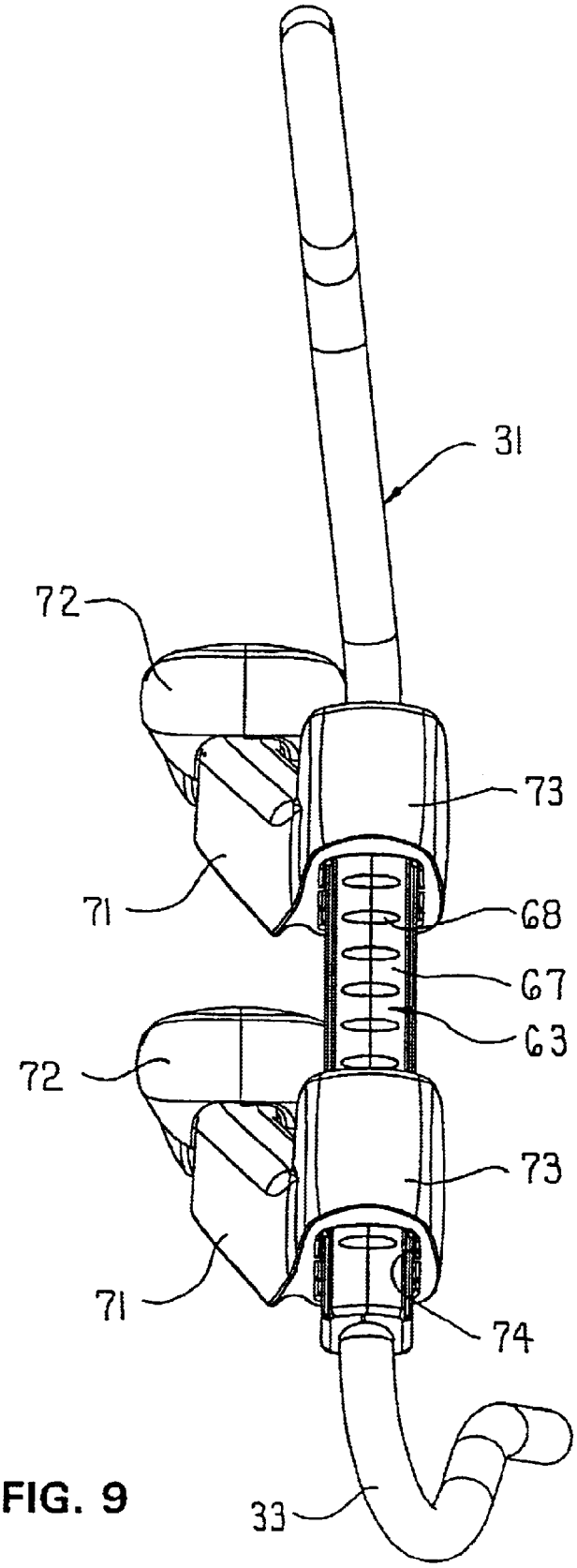
FIG. 9 is a rear elevational view of the arrangement shown in FIGS. 7–8 and again showing both elevational positions of the chair arm in solid lines.

With the height-adjusting arm arrangement of the present invention, the individual arms can each be vertically adjusted in height from an uppermost position as illustrated in FIGS. 7–9 to the lowermost position illustrated therein. This height adjustment range is preferably between about seven inches, with the arm when at the upper limit as illustrated in FIGS. 7–9 typically being at the uppermost height which is conventionally provided for arms associated with office type chairs. Conversely, however, when the arm is in the lowermost position illustrated in FIGS. 7–9, the arm is now disposed so that it is positioned closely adjacent the outer side edges of the seat arrangement 14, and elevationally is positioned closely adjacent or just slightly above the upper surface of the seat arrangement, whereby in this latter position the arms are at an elevation whereby they are compactly stored directly adjacent the seat arrangement, and thus the chair in its entirety, except for the back arrangement, can be readily stored in a position under even low tabletops or worksurfaces. Further, even when the chair is occupied, the arms can be disposed in this lowermost position whereby they do not interfere with the occupant's movements if the occupant prefers to have the sides of the chair seat free of obstructions.

The operation of the height-adjusting arms is extremely simple since, if the occupant when sitting in the chair grips the arm 71 adjacent the rear end thereof and lifts upwardly, this causes the arm to rock about the bearing rib 76, thereby causing the locking rib 75 to be withdrawn from engagement with the rack. The operator can then move the arm vertically, either upwardly or downwardly, since the spring 77 will merely function like a releasable detent and effectively "click" upwardly or downwardly along the support tube 63 and hence define the various locking positions. When the arm reaches the desired elevational position, the operator then allows the arm to tilt back downwardly causing the locking rib 75 to engage the respective recess 66 associated with the rack, thereby relocking the arm in the selected position, substantially in the manner illustrated by FIG. 7. In this locking position, the weight of the arm tending to swing it downwardly (counter-clockwise in FIG. 7) thus effectively maintains the support hub 73 of the arm in locked engagement with the support tube 63. No additional complex locking mechanisms are required, and in addition no separate levers or trigger mechanisms are required so as to release the arm for height adjustment purposes.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A chair comprising:

an upright back including upper and lower ends;

a frame including laterally spaced first and second rigid uprights positioned adjacent opposite sides of said back;

a seat attached to said frame adjacent said lower end of said back;

a pivot assembly coupling said first and second uprights to said back for permitting pivoting of said back about a substantially horizontal pivot axis which projects laterally of said back and is positioned in the vicinity of said upper end of said back;

a spring arrangement that exerts a force on said back a substantial distance below said pivot axis for biasing said back toward a forward position; and a restraining arrangement coacting between said back and said frame for limiting pivoting movement of said back about said pivot axis to a small angle defined between a rearward position and said forward position;

said restraining arrangement including first and second spaced apart rod portions which are fixed to said frame and extend transversely relative to said pivot axis adjacent said back, and a pair of yokes which are fixed to and project rearwardly of said back, each yoke extending around a respective one of said first and second rod portions, whereby said back can pivot forwardly until said rod portions contact a closed end of the yoke.

2. A chair comprising:

an upright back including upper and lower ends;

a frame including laterally spaced first and second rigid uprights positioned adjacent opposite sides of said back;

a seat attached to said frame adjacent said lower end of said back;

a pivot assembly coupling said first and second uprights to said back for permitting pivoting of said back about a substantially horizontal pivot axis which projects laterally of said back and is positioned in the vicinity of said upper end of said back;

a spring arrangement that exerts a force on said back a substantial distance below said pivot axis for biasing said back toward a forward position;

said spring arrangement including at least one coil spring which has one spring leg that is engaged with said back near a midpoint between said upper and lower ends thereof; and said spring arrangement including a second leg acting against an elongate lever arm at a location spaced downwardly from said pivot axis to bias said back toward said forward position.

3. The chair according to claim 2, wherein a cross bar is positioned substantially below said pivot axis; and said one coil spring being at least partially wound therearound.

4. The chair according to claim 3, wherein said spring arrangement includes a pair of said coil springs surrounding said cross bar;

each of said pair of coil springs includes one leg anchored to said cross bar and a second leg anchored to said back, wherein each of said second legs are joined together to form a U-shaped configuration that exerts a biasing force near a midpoint of said chair back to bias said back toward the forward position.

5. A chair comprising:

an upright back member including upper and lower ends;

a frame including laterally spaced first and second rigid uprights positioned adjacent opposite sides of said back member;

a seat attached to said frame adjacent said lower end of said back member;

a pivot assembly coupling said first and second uprights to said back for permitting pivoting of said back member about a substantially horizontal pivot axis which projects laterally of said back and is positioned in the vicinity of said upper end of said back member;

said pivot assembly including a transverse shaft which is fixed to said frame and includes pivot shaft parts which are positioned adjacent opposite sides of the back member and extend generally along the pivot axis for fixed securement to said uprights adjacent upper ends thereof, and a pair of bearing journal parts fixed to said back member adjacent opposite sides thereof in the vicinity of said upper end and disposed in rotative supportive engagement with the respective pivot shaft parts;

said transverse shaft having a center shaft part which is positioned adjacent said back member and projects downwardly a substantial distance away from said pivot axis to a location at least approximately midway between the upper and lower ends of the back member;

said center shaft part having a generally upwardly-oriented U-shaped configuration defined by a lower shaft segment which is generally parallel with but displaced vertically downwardly a substantial distance below said pivot axis and a pair of upright shaft segments which at lower ends join to opposite ends of said center shaft segment and which at upper ends join to inner ends of the respective pivot shaft parts with the latter having outer ends thereof fixedly joined to the respective uprights; and a stop arrangement cooperating between said back member and said center shaft part for restricting rearward swinging of said back member about said pivot axis to a rear position.

6. A chair according to claim 5, including a spring biasing structure cooperating between said center shaft part and said back member for normally urging said back member to swing about said pivot axis forwardly away from said rear position, said spring biasing structure exerting a biasing force against said back member at a location which is positioned downwardly a substantial distance below said pivot axis.

7. A chair according to claim 5, including a biasing spring mounted on the center shaft segment and having a part thereof disposed in biasing engagement with a rear surface of the back member at a location spaced downwardly a substantial distance below the pivot axis for normally pivotally urging the back member forwardly away from said rear position.

8. A chair according to claim 5, including a pair of sidewardly-spaced restraining members fixed to said back member at a location spaced downwardly from said pivot axis and projecting rearwardly therefrom, each said restraining member cooperating with the back member to define an elongate closed slot through which one of the upright shaft segments vertically projects for restricting the pivotal movement of the back member about said pivot axis to a small angle as defined between front and rear positions of the back member.

9. A chair according to claim 8, wherein said restraining members cooperate with the upright shaft segments of said center shaft part at a location positioned closely adjacent the lower ends thereof, and wherein a spring is mounted on the center shaft segment and has a part thereof disposed in biasing engagement with a rear surface of the back member at a location positioned in close proximity to the center shaft segment for normally urging the back member to swing in a forward direction about said pivot axis.

10. A chair according to claim 5, wherein said transverse shaft including said pivot shaft parts and said center shaft part are formed from a one-piece monolithic cylindrical rod member.

11. A chair comprising:

an upright back member including upper and lower ends;

a frame including laterally spaced first and second rigid uprights positioned adjacent opposite sides of said back member;

a seat attached to said frame adjacent said lower end of said back member;

a pivot assembly coupling said first and second uprights to said back for permitting pivoting of said back member about a substantially horizontal pivot axis which projects laterally of said back and is positioned in the vicinity of said upper end of said back member;

said pivot assembly including a transverse shaft which is fixed to said frame and includes pivot shaft parts which are positioned adjacent opposite sides of the back member and extend generally along the pivot axis for fixed securement to said uprights adjacent upper ends thereof, and a pair of bearing journal parts fixed to said back member adjacent opposite sides thereof in the vicinity of said upper end and disposed in rotative supportive engagement with the respective pivot shaft parts;

said transverse shaft having a center shaft part which is positioned adjacent said back member and projects downwardly a substantial distance away from said pivot axis to a location at least approximately midway between the upper and lower ends of the back member;

said transverse shaft including said pivot shaft parts and said center shaft part being formed from a one-piece monolithic cylindrical rod member; and a stop arrangement cooperating between said back member and said center shaft part for restricting rearward swinging of said back member about said pivot axis to a rear position.

12. A chair comprising:

an upright back arrangement having upper and lower edges, said back arrangement including an upright structural back member and an outer rear cover which overlies a rear side of said back member and is secured thereto and defines a small interior space therebetween;

a frame including laterally spaced first and second rigid uprights positioned adjacent opposite sides of said back arrangement, said first and second uprights being positioned exteriorly of said back arrangement and having upper ends positioned adjacent opposite upper corners of said back arrangement;

a seat attached to said frame adjacent said lower edge of said back;

a pivot assembly positioned within said interior space and coupling said first and second uprights to said back arrangement for permitting pivoting of said back arrangement about a substantially horizontal pivot axis which projects laterally of said back arrangement adjacent said upper edge thereof;

said pivot assembly including a transverse pivot shaft arrangement having parts positioned adjacent opposite upper corners of the back member so as to extend generally along the pivot axis and fixed to said uprights adjacent the upper ends thereof, and a pair of bearing journal parts fixed to said back member adjacent opposite upper corners thereof and disposed in rotative supportive engagement with the respective pivot shaft parts;

an elongate arm fixed to said transverse shaft arrangement and positioned within said interior space adjacent from said pivot axis to a location wherein a back member, said arm projecting downwardly a substantial part of said arm is positioned approximately midway between the upper and lower edges of the back arrangement; and a spring biasing structure disposed within said interior space and cooperating between said lower end part of said arm and said back member for normally urging said back arrangement to swing about said pivot axis forwardly toward a forward position, said spring biasing structure exerting a biasing force against said back member at a location positioned downwardly a substantial distance below said pivot axis.

13. The chair according to claim 12, including a restraining arrangement coacting between said back member and said arm for limiting pivoting movement of said back arrangement about said pivot axis to a small angle defined between a rearward position and said forward position.

14. The chair according to claim 13, wherein said restraining arrangement includes a yoke which is fixed to and projects rearwardly of said back member and extends around said arm.

15. The chair according to claim 12, wherein said spring biasing structure includes at least one coil spring which has one spring leg engaged with said back member near a midpoint between upper and lower ends thereof, and a second spring leg acting against said elongate arm at a location spaced a substantial distance downwardly from said pivot axis to bias said back arrangement toward said forward position.

16. The chair according to claim 15, wherein the elongate arm includes a cross bar positioned substantially midway between said upper and lower edges of said back arrangement, and said one coil spring being at least partially wound around said cross bar.

* * * * *

UNITED STATES PATENT AND TRADEMARK OFFICE

CERTIFICATE OF CORRECTION

PATENT NO. : 6,672,669 B2
DATED : January 6, 2004
INVENTOR(S) : Zooey C. Chu et al.

It is certified that error appears in the above-identified patent and that said Letters Patent is hereby corrected as shown below:

Title page,
Please change
"[75] Inventors: Zooey C. Chu, Grand Rapids, MI (US)
David J. Lambert, Madison, MS (US)" to
-- [75] Inventors: Zooey C. Chu, Grand Rapids, MI (US)
David J. Lambert, Baldwyn, MS (US) --

Column 10,
Lines 15-20, Change "an elongate arm fixed to said transverse shaft arrangement and positioned within said interior space adjacent from said pivot axis to a location wherein a back member, said arm projecting downwardly a substantial part of said arm is positioned approximately midway between the upper and lower edges of the back arrangement; and" to -- an elongate arm fixed to said transverse shaft arrangement and positioned within said interior space adjacent said back member, said arm projecting downwardly a substantial distance away from said pivot axis to a location wherein a lower end part of said arm is positioned approximately midway between the upper and lower edges of the back arrangment; and --.

Signed and Sealed this

Thirteenth Day of April, 2004

JON W. DUDAS
*Acting Director of the United States Patent and Trademark Office*